US008578833B2

(12) United States Patent
Radstake et al.

(10) Patent No.: US 8,578,833 B2
(45) Date of Patent: Nov. 12, 2013

(54) OBJECT PROTECTION FROM HOLLOW CHARGES AND METHOD FOR THE PRODUCTION THEREOF

(75) Inventors: Marc Radstake, Steffisburg (CH); Hanspeter Kaufmann, Cornol (CH)

(73) Assignee: RUAG Schweiz AG, Emmen (CH)

( * ) Notice: Subject to any disclaimer, the term of this patent is extended or adjusted under 35 U.S.C. 154(b) by 110 days.

(21) Appl. No.: 12/998,995

(22) PCT Filed: Dec. 19, 2009

(86) PCT No.: PCT/CH2009/000407
§ 371 (c)(1),
(2), (4) Date: Jun. 22, 2011

(87) PCT Pub. No.: WO2010/075637
PCT Pub. Date: Jul. 8, 2010

(65) Prior Publication Data

US 2011/0252955 A1 Oct. 20, 2011

(30) Foreign Application Priority Data

Dec. 29, 2008 (EP) ..... 08405315

(51) Int. Cl.
*F41H 5/02* (2006.01)

(52) U.S. Cl.
USPC ..... 89/36.02; 428/105

(58) Field of Classification Search
USPC ..... 89/36.01–36.17
See application file for complete search history.

(56) References Cited

U.S. PATENT DOCUMENTS

| | | | | |
|---|---|---|---|---|
| 3,573,150 | A * | 3/1971 | Broutman et al. | 28/105 |
| 5,214,235 | A * | 5/1993 | Froeschner | 89/36.13 |
| 5,392,687 | A * | 2/1995 | Shiells | 89/36.17 |
| 6,311,605 | B1 | 11/2001 | Kellner et al. | |
| 7,900,548 | B2 | 3/2011 | Hoadley et al. | |
| 8,011,285 | B2 | 9/2011 | Farinella et al. | |
| 8,042,449 | B2 | 10/2011 | Farinella et al. | |
| 8,132,493 | B1 * | 3/2012 | Adams | 89/36.02 |
| 2009/0031889 | A1 * | 2/2009 | Saul et al. | 89/36.02 |

(Continued)

FOREIGN PATENT DOCUMENTS

| | | |
|---|---|---|
| DE | 688 526 | 2/1940 |
| DE | 26 01 562 | 1/1977 |
| DE | 198 25 260 | 12/1999 |
| FR | 1 103 549 | 11/1955 |
| WO | WO 2009/091373 | 7/2009 |
| WO | WO 2010/008428 | 1/2010 |
| WO | WO 2011/057628 | 5/2011 |

OTHER PUBLICATIONS

International Search Report of PCT/CH2009/000407, Jun. 9, 2010.
English translation of International Preliminary Report on Patentability and Written Opinion of the International Searching Authority in PCT/CH2009/000407, Aug. 2, 2011 (IPRP).

*Primary Examiner* — Samir Abdosh
(74) *Attorney, Agent, or Firm* — Collard & Roe, P.C.

(57) ABSTRACT

Lightly armored vehicles and stationary objects are often the target of attacks by means of hollow-charge projectiles. Numerous variants of armor plating have been developed to counter such attacks, which results in additional loads, and these require expensive production. A light protective layer (1) which is simple to produce contains rods (3) arranged in a matrix, which project out from the object to be protected. If a corresponding hollow-charge projectile hits such a protective layer (1), the front nose (101) thereof is damaged, so that in most cases the initiation of the hollow charge does not occur. Preferably the rods (3) are covered externally by polymer layers (9, 10) and additionally a crumple layer (8) is attached in front of the object to be protected.

4 Claims, 9 Drawing Sheets

(56) References Cited

U.S. PATENT DOCUMENTS

Figure 1:
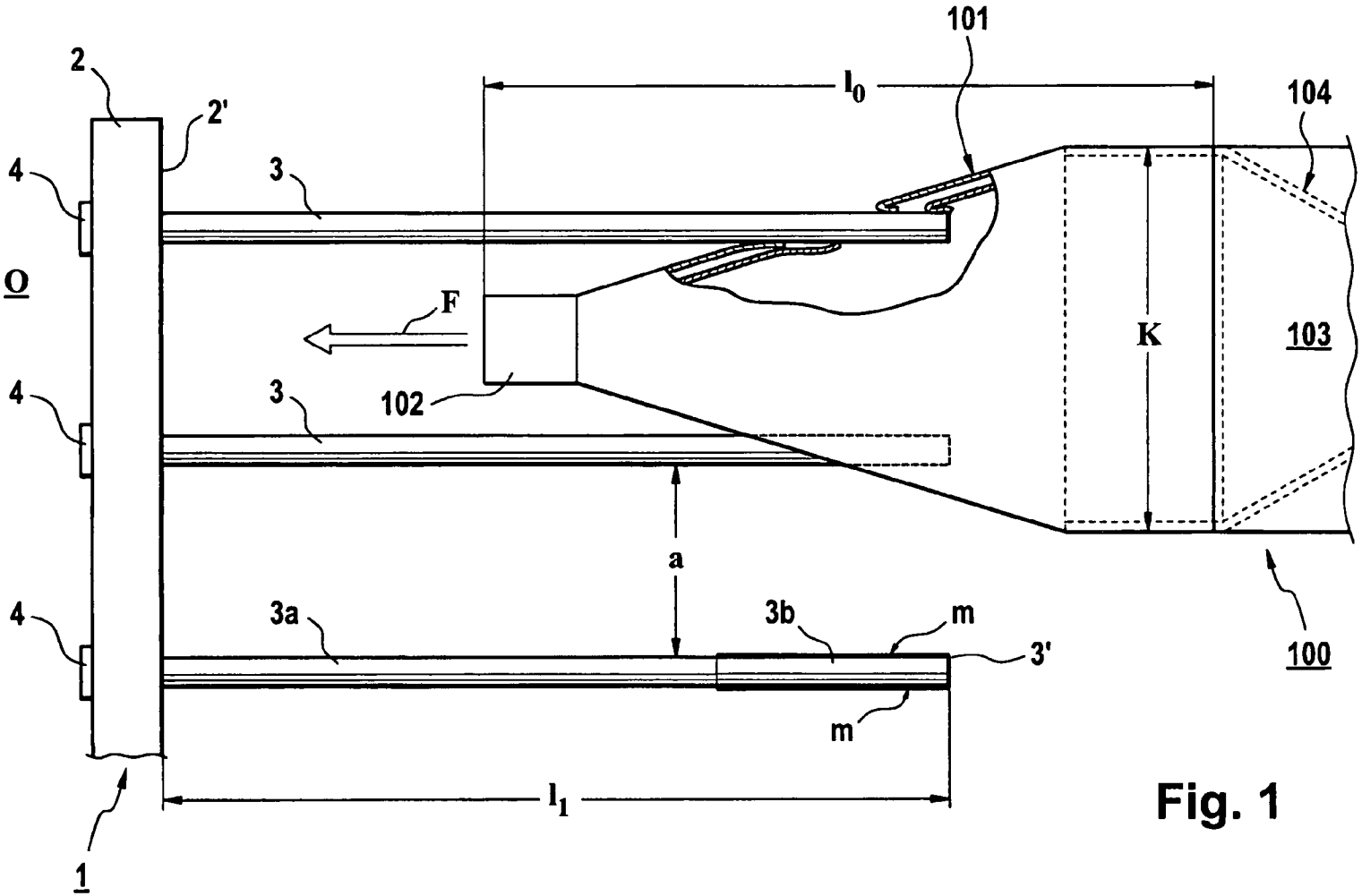

| | | | | |
|---|---|---|---|---|
| 2009/0266226 | A1 | 10/2009 | Beach et al. | |
| 2009/0272254 | A1* | 11/2009 | Hunn et al. | 89/36.02 |
| 2011/0067561 | A1* | 3/2011 | Joynt | 89/36.02 |
| 2011/0252955 | A1* | 10/2011 | Radstake et al. | 89/36.02 |
| 2011/0259184 | A1* | 10/2011 | Adams et al. | 89/36.02 |
| 2012/0174756 | A1* | 7/2012 | Wilson | 89/36.02 |
| 2012/0186427 | A1* | 7/2012 | Adams et al. | 89/36.02 |

* cited by examiner

Fig. 4a
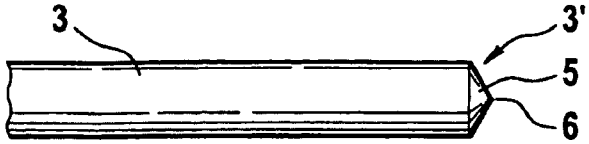
Fig. 4b
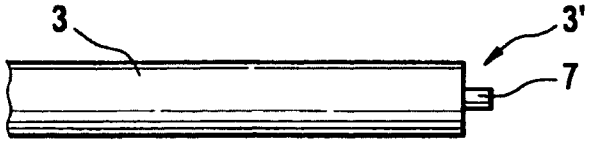
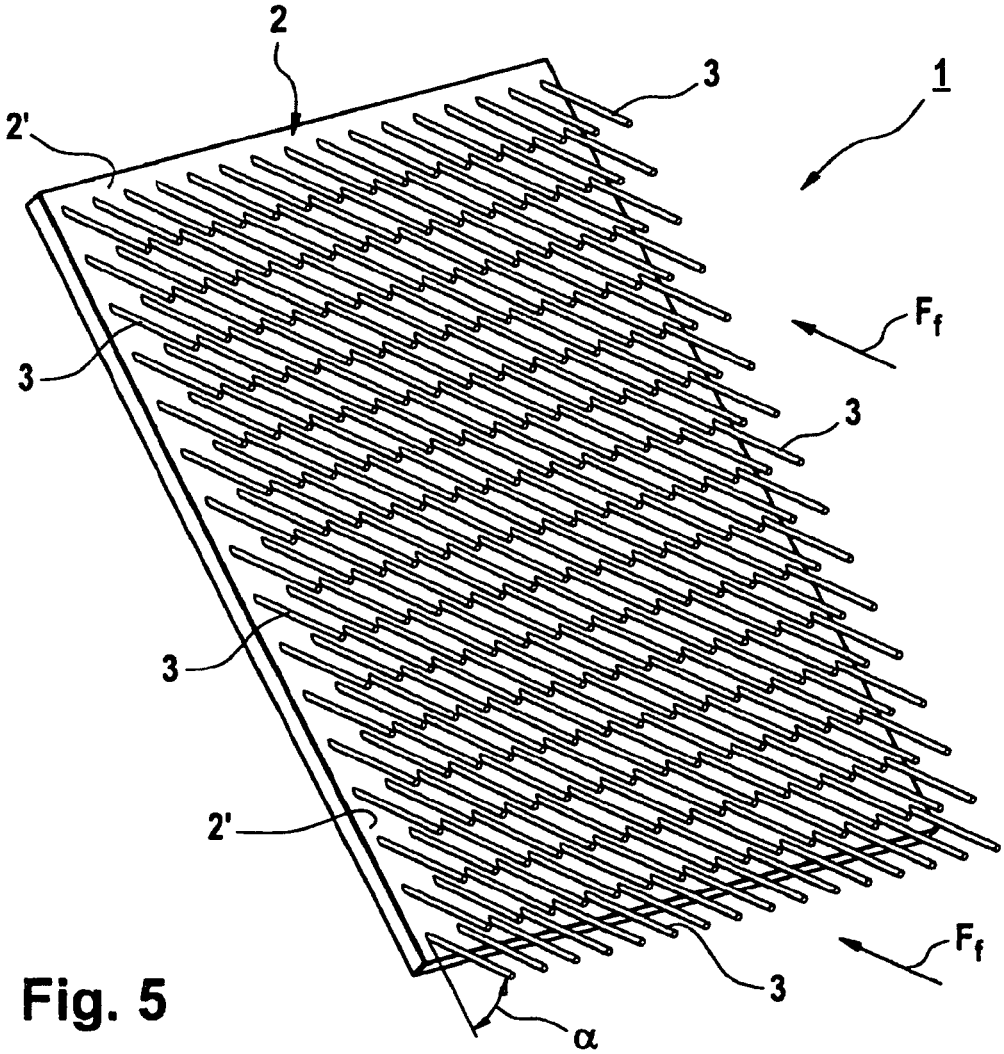
Fig. 5

OBJECT PROTECTION FROM HOLLOW CHARGES AND METHOD FOR THE PRODUCTION THEREOF

CROSS REFERENCE TO RELATED APPLICATIONS

This application is the National Stage of PCT/CH2009/000407 filed on Dec. 19, 2009, which claims priority under 35 U.S.C. §119 of European Application No. 08405315.6 filed on Dec. 29, 2008, the disclosure of which is incorporated by reference. The international application under PCT article 21(2) was not published in English.

The present invention relates to object protection against unguided medium-calibre projectiles and/or subsonic medium-calibre projectiles with electric impact fuses which are axially arranged at the front with two-dimensional connection cables for connecting to the ignition chain, the object to be protected having a protective layer with metallic bodies which are arranged in a matrix and project from a surface.

In the Second World War, for the first time projectiles with hollow charges were used against armoured targets. This was done on one hand by the US armed forces (a weapon referred to as a bazooka) and on the other hand by Germany (referred to as "Panzerfaust" and "Panzerschreck"). Propellents such as charges and propellant cartridges served to accelerate the projectiles. Then Russia developed a widely-used weapon, referred to as an RPG (rocket-propelled grenade). This is still used today, in a version produced since 1961, above all in the field of asymmetric warfare as type RPG-7, with very widely-varying hollow charges. Whereas the early systems had mechanical impact fuses, the more recent ones are equipped with piezoelectric ignition devices at the front and have planar, galvanically conductive connection cables between the ignition generator and the ignition chain. These relatively simple, usually rocket-propelled, medium-calibre projectiles are widely used throughout the world and represent an enormous risk potential; they are inexpensive to acquire, easy to handle and are used in very widely-varying embodiments against stationary and mobile objects, in particular against lightly armoured vehicles.

In addition to very widely-varying active and passive armour-plating, as early as 1940 (DE-A-688 526) solid steel rods and prismatic bodies were placed on the object to be protected, which were intended to deflect in particular projectiles from anti-tank guns. A further development thereof (DT-A1-26 01 562) used special heat-resistant materials and also armour plating with solid bodies arranged in a matrix and projecting from a surface (FIG. 1 and FIG. 2), in order to keep the exothermic effect of explosive charges away from the object to be protected.

Both aforementioned protective arrangements have the disadvantage that although they to a certain degree reduce the destructive effect of the projectiles for example of an impacting and ignited hollow charge, they cannot prevent the initiation thereof.

It is therefore an object of the invention to provide an object protection which as far as possible prevents the initiation of the explosive charge or at least impairs it and, should the charge nevertheless be ignited, reduces the effect thereof to such a great extent that the operation of the object is not substantially disrupted.

This object is achieved in that the bodies are formed as rods or pins, with at least their surfaces in the end region which is remote from the object to be protected being galvanically conductive, in that these rods or pins project beyond an upper inner surface of the protective layer, in that the diagonal distance between the rods is less than the calibre of the active projectile and greater than the tip of the projectile.

The surface mentioned in the claim may be flat or any spatial surface whatsoever. The holding of the rods or pins may be effected in the surface and/or the rods may be fixed therebehind in a solid plate.

The features of the arrangement of the rods or pins allow the projectile partial penetration with its nose into the matrix. In this case, surprisingly the ignition function is directly disrupted to such a great extent that in most cases no initiation of the charge at all takes place. Should ignition nevertheless take place in individual cases, in the case of precision charges the optimum distance (standoff) of the hollow charge from the target is exceeded, which is known to result in a considerable reduction of the jet power thereof and/or only in simple burning-up. In conjunction with conventional protective measures (passive and/or active armour-plating), in such cases too the object is sufficiently protected.

A prerequisite for the prevention of initiation of the ignition are rods or pins which are galvanically conductive at least in the part which is acted upon directly by the projectile.

The essential advantages over only conventional protective measures are the relatively low weight of the subject of the invention, the simple production thereof, its low costs and the ability to retrofit on already existing objects.

Advantageous developments of the subject of the invention are characterised in subsequent dependent claims. Therein, the comprehensive term "rod" is used, since the cross-section of these bodies is relatively small compared with their length. Likewise, the term "pin" (short rod) applies for most embodiments, because for material-related reasons and for reasons of weight the length of the rods is selected to be as short as is functionally useful.

What are beneficial, in particular on vehicles, are cover surfaces which are as continuous as possible, under which the rods are "concealed". If the rods 3 are covered on their outer end faces by at least one planar and continuous outer layer, the risk of injury is eliminated and in addition deposits of dirt and bending of the rods can thereby be avoided.

The threat situation and the probable trajectory of a projectile relative to the orientation of the rods is taken into account in that the rods are arranged at an angle to the surface which corresponds to the probable presumed direction of flight on the object to be protected.

Simple orientation of the rods to the current threat, in particular in the case of viewing slots of armoured vehicles, considerably increases the security from direct fire. This is achieved by arranging the rods in rows on a tiltable carrier which is in an operative connection with tiltable carriers of further rows. Subsequent adjustment of the few necessary rows can take place automatically, for example by a level regulation means. Particularly at risk and hence especially worth protecting are entry and exit points on vehicles (air intakes, exhausts, fuel filler pipes, hatches for personnel and maintenance such as doors, covers etc.) and also inspection windows for optical and electronic equipment.

If the end faces of the rods are provided with obtuse-angled cones which end in sharp tips, or if these end faces are provided with a central sharp-edged stud, this in many cases, even in the event of direct, perpendicular impacting of the projectile tip on a rod, results in direct destruction of the piezoelectric crystal in the impact fuse. In the case of front-mounted piezo generators, the voltage drops below the necessary ignition voltage due to splintering of the crystal, so that the initiation of the charge does not occur.

The rods can be fastened particularly simply in a solid plate out of which they project.

A solid plate can be equipped very simply with rods and in addition also has the advantage that it is effective protection against small-calibre ammunition.

Protection with rods which project out of the nodes of a steel net is economically beneficial and also temporarily usable.

A crumple layer which is mounted in front of the inner surface mentioned in claim 1 and absorbs part of the kinetic energy of an impacting projectile is very advantageous.

A corrugated perforated plate made of steel sheet or a multi-layer composite plate has proved useful as a crumple layer.

What is particularly advantageous are crumple layers in combination with solid inserts which have a high dispersive effect for a hollow-charge jet. This also includes the presence of a layer made from a metallic sponge.

In order to save weight, in particular in movable protective layers, and/or to reduce the reflection of electromagnetic radiation (radar, infrared etc.), in a further variant the rods consist of an electrically non-conductive or only slightly electrically conductive material and have a galvanically conductive coating in their end regions.

Very lightweight and inexpensive protective layers can be produced from flat material (metal sheet) by means of jet or beam machining (laser, water-jet, etc.), which layers can also be integrated in widely-varying systems.

A method for the particularly economic production of a protective layer consists in that surfaces with a U-shaped contour are cut out from a metal strip at equal distances such that rods with a web remain. Punching tools can also be used for this. In such case, the rod-shaped metal strips are effective for protection; the webs merely serve for holding and adopt the function of a plate.

In a further preferred embodiment, the cut-out metal strips with their webs are placed on carriers and are connected thereto in non-positive manner.

In order to reduce weight in webs and carriers which are under low mechanical load, in addition cutouts are cut out at equal distances.

Figure 2:
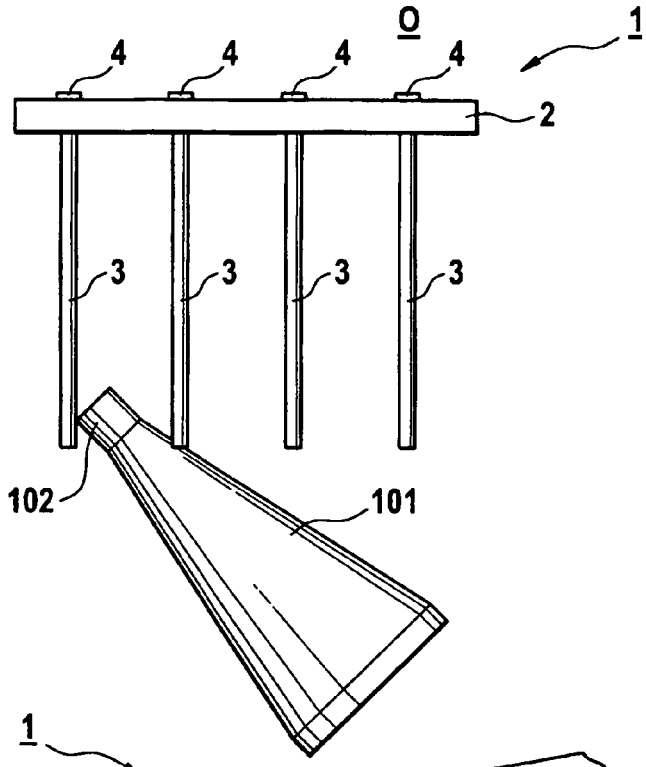
Figure 3:
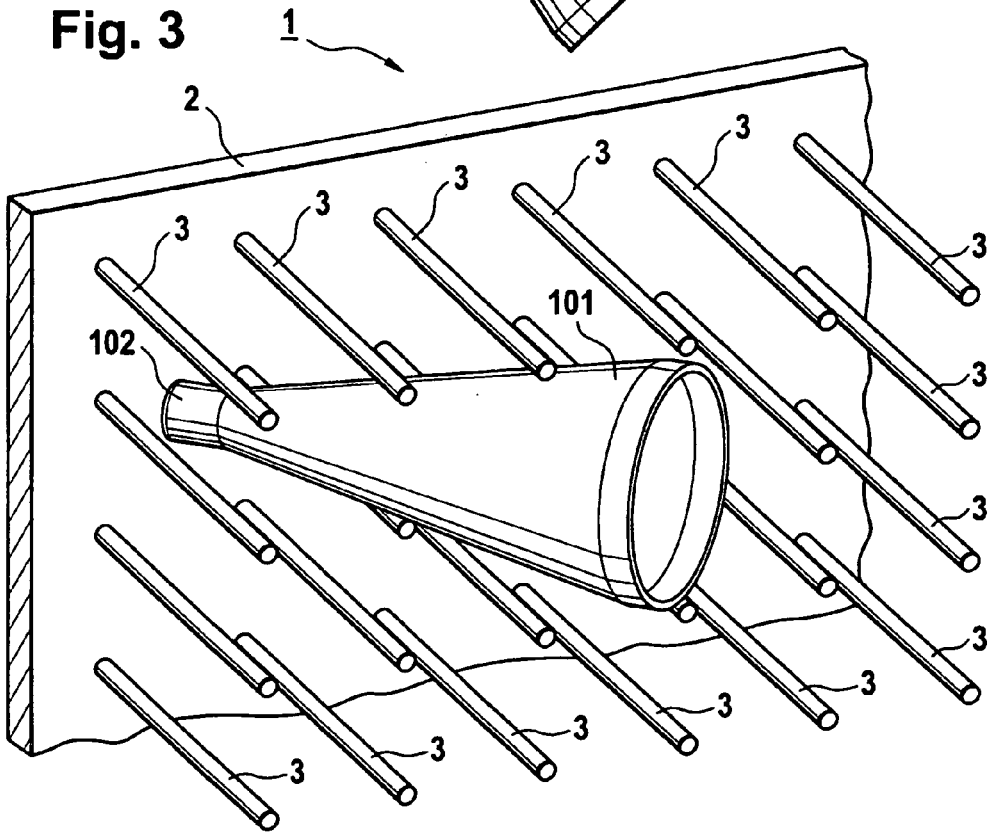
Figure 6:
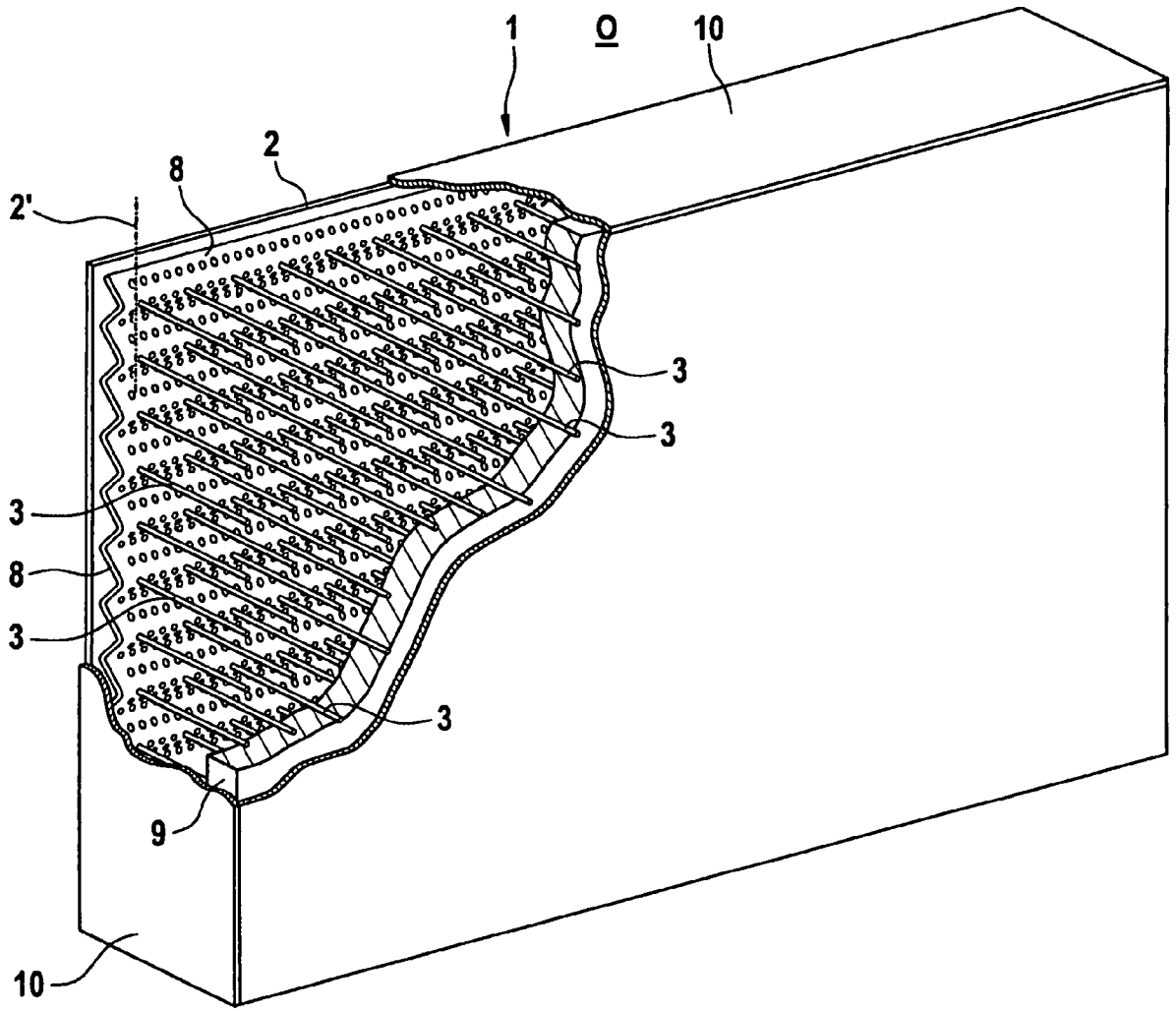
Figure 7:
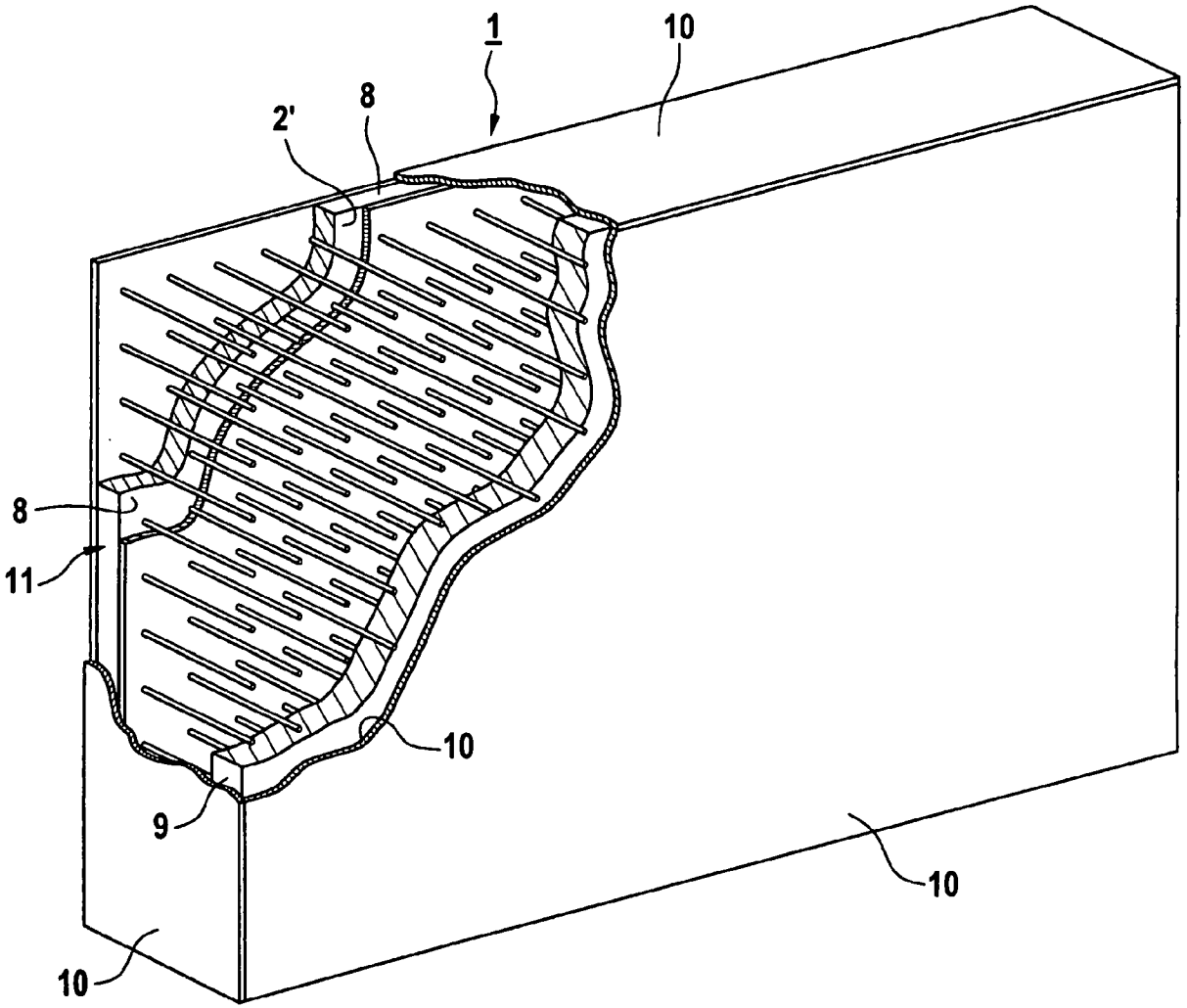
Figure 8:
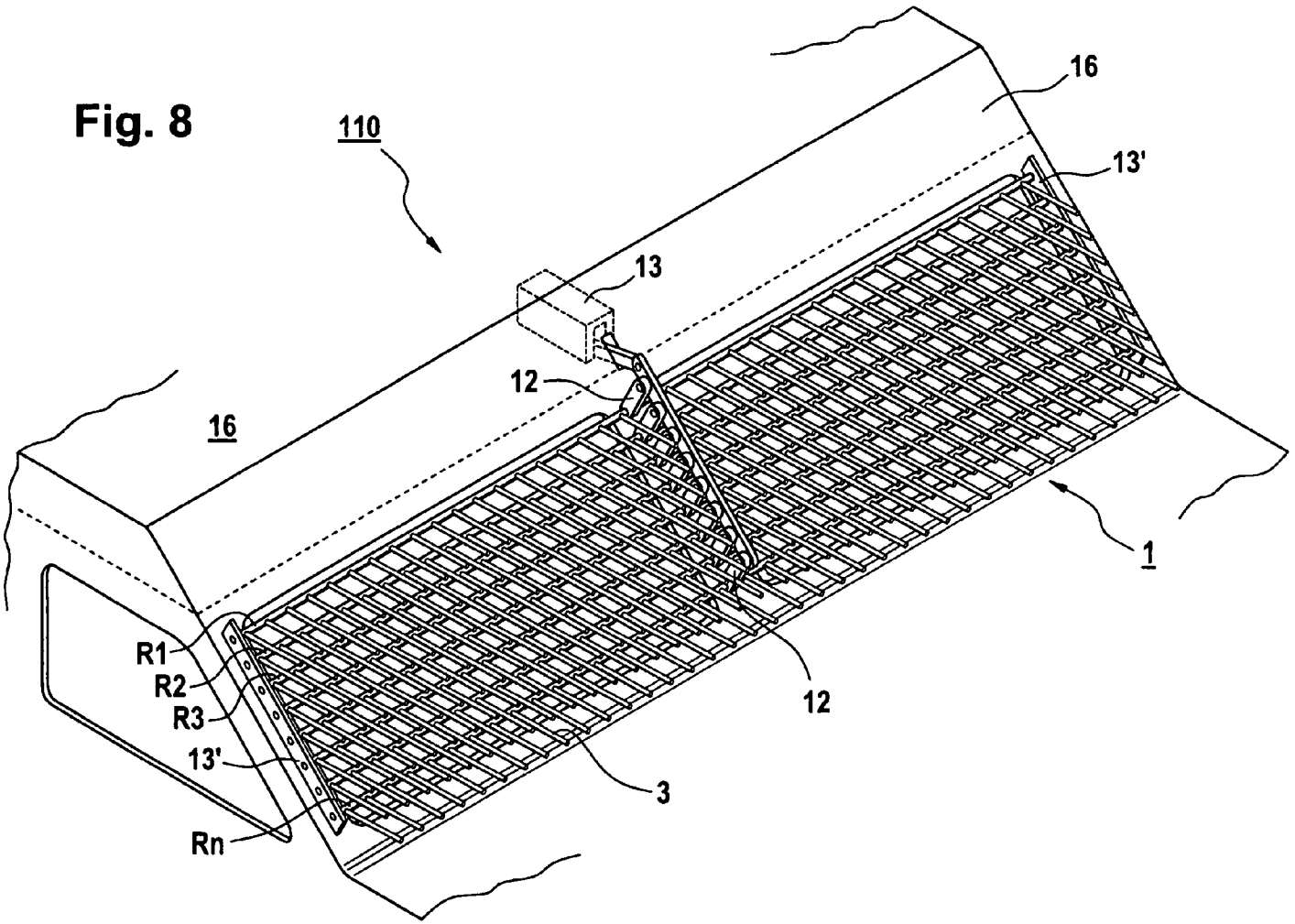
Figure 9:
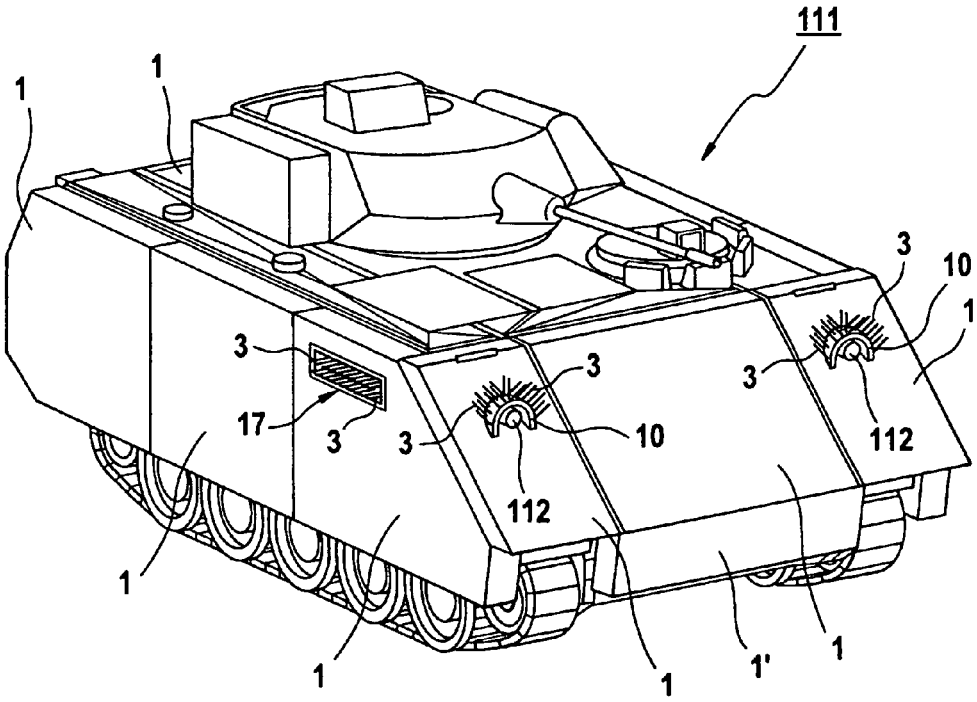
Figure 10:
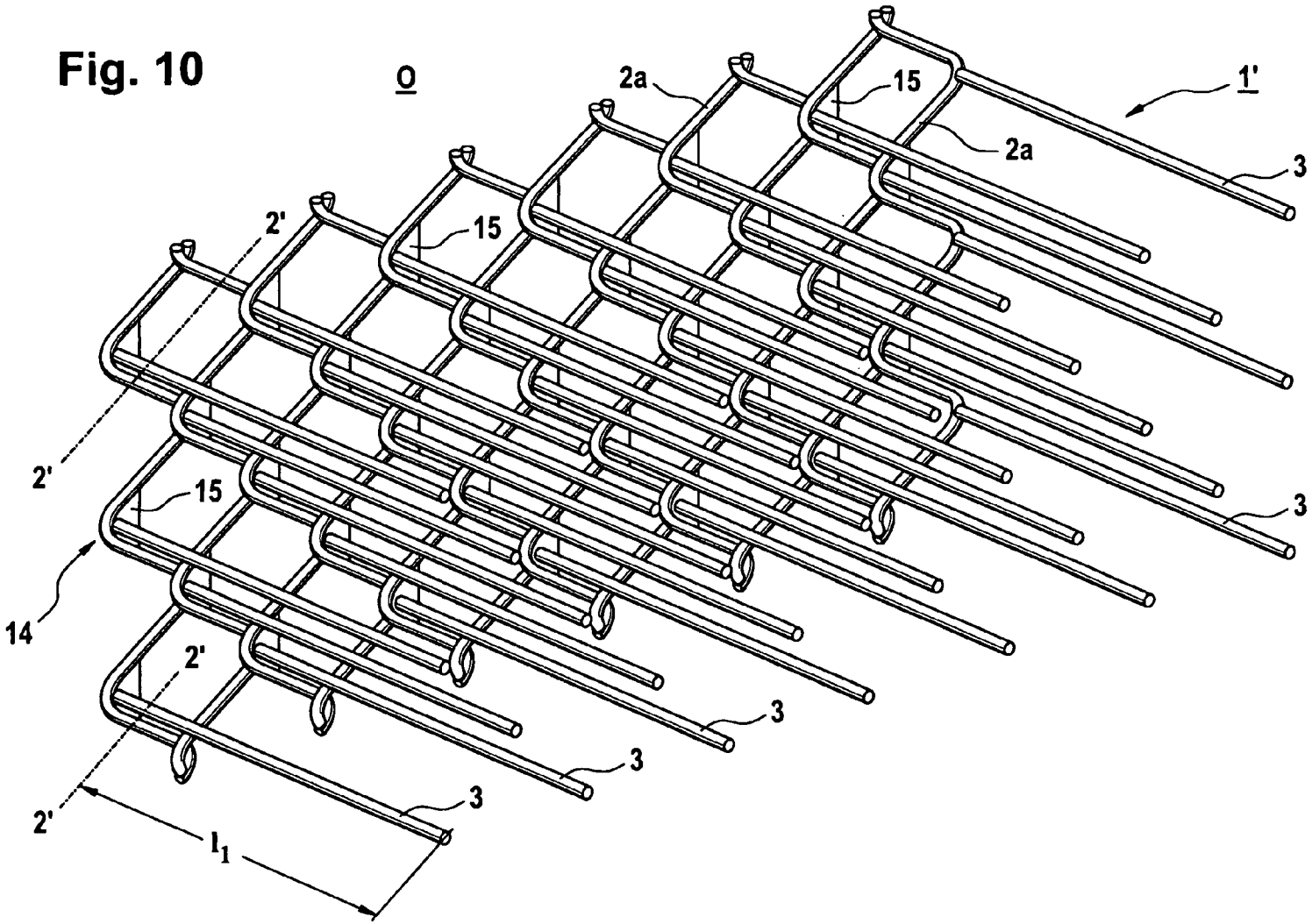
Figure 11:
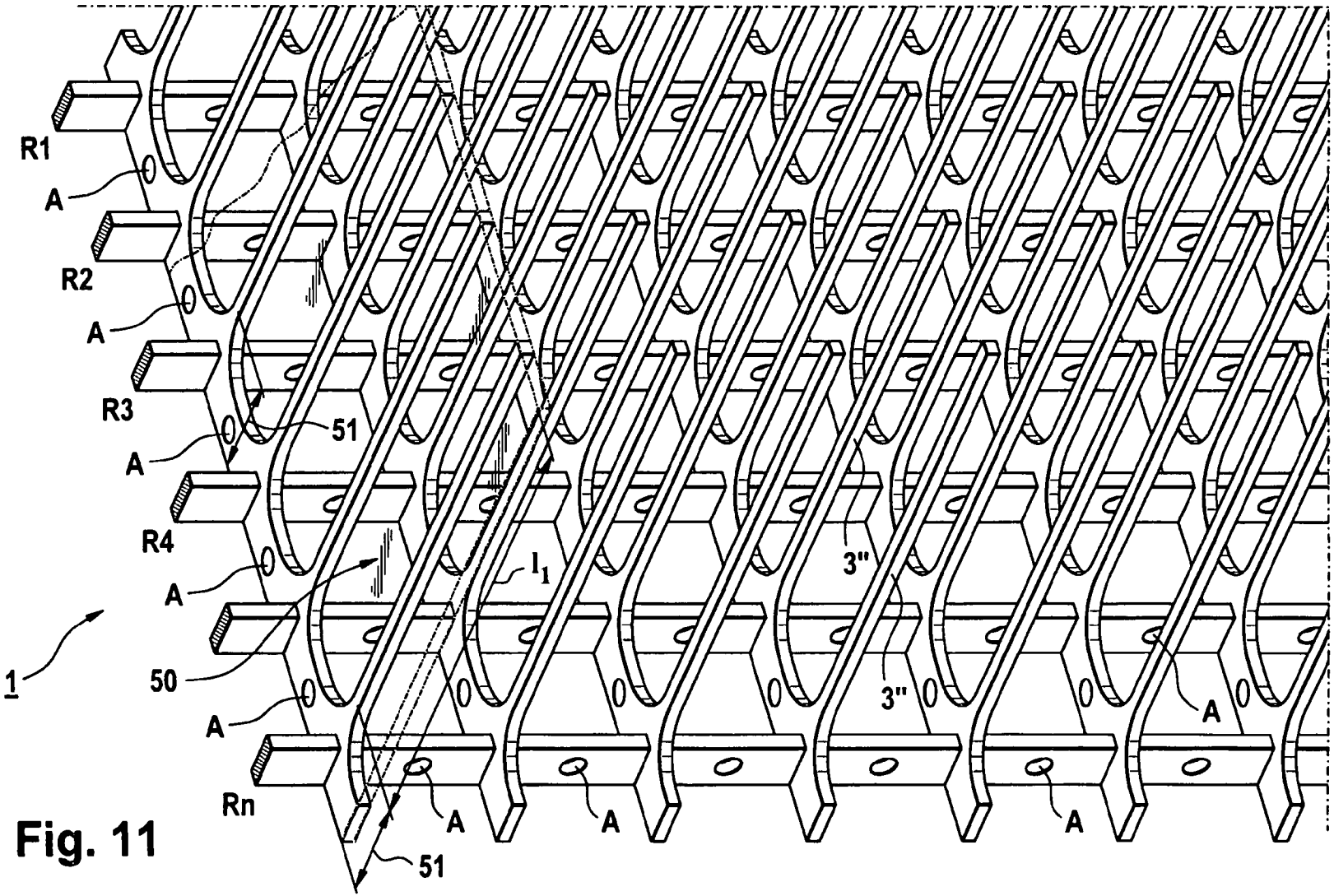

Examples of embodiment of the invention will be illustrated and described below with reference to drawings. These show:

FIG. 1 the principle of preventing the initiation of a hollow charge by means of a protective layer, with a rod which is only galvanically conductive in an end region being present as a variant, FIG. 2 a nose of a projectile upon impacting on a protective layer, FIG. 3 a further illustration of a projectile flying obliquely upon impacting on a protective layer, FIG. 4*a* a rod of a protective layer with conical tip, FIG. 4*b* a rod of a protective layer with sharp-edged stud, FIG. 5 a modular base plate with inclined rods, FIG. 6 a modular protective layer with internal crumple layer and outer cladding, FIG. 7 a variant of a protective layer with outer cladding, FIG. 8 the principle of a see-through and adjustable protective layer in front of the windscreen of an armoured vehicle, FIG. 9 an armoured personnel carrier with modular and special protective layers, also for sensors and inlets and outlets, FIG. 10 a protective layer consisting of a steel net with rods inserted into the nodes of the net, and FIG. 11 a protective layer of lightweight construction produced from metal strips which are cut out by means of jet or beam machining.

In all the figures, identical functional elements are provided with identical reference numerals.

In FIG. 1, 1 designates a protective layer. Matrix-like rods 3 are inserted in a base plate 2 and are fixed on the rear side with flanges 4 on the base plate 2. The rods 3 project across an inner surface 2' by a length $l_1$. A projectile 100 which impacts on an object to be protected O in the direction of flight F penetrates with its impact fuse 102 between the rods 3. A thin-walled double nose 101 of the projectile 100 is perforated in so doing and electrically short-circuited by the end regions 3*b* of the rods 3, so that the front impact fuse 102 with its piezo sensor can no longer become active. The double nose 101, from a physical point of view, is a two-dimensional two-wire cable for the ignition energy. It connects the impact fuse 102 in a well-known manner to an ignition chain which accelerates the hollow charge (not shown). The diagonal distance a between the rods 3, 3*a*, 3*b* of a matrix consisting of a plurality of rods 3 is at most less than the calibre K of the active projectile. In any case, the double nose 101 is thereby "skewered" and short-circuited, but at least is compressed; see partial sectional representation in FIG. 1. The entire length $l_0$ of the nose 101, measured from the tip of the impact fuse 102 up to the maximum diameter of a liner 104 of a hollow charge 103, is shorter than the free length $l_1$ of the rods 3. Thus it is ensured that a nose 101 which has penetrated into the protective layer 1 is damaged before the impact fuse 102 can be activated. The tips 3' of the rods 3 are sharp-edged and consist of hardened steel and/or have an galvanically conductive coating.

Tests with rocket-propelled hollow charges with an impact velocity of 300 m/s on the protective layer 1 have shown that the initiation of the hollow charge is prevented with virtually 100% probability, if the direction of flight F is parallel to the rods 3. The tests were carried out with projectiles with a calibre of 85 mm and with a matrix with rods 3 of a diameter of 6.5 mm made from high-strength steel with hardened tips 3'. The maximum distances a between the rods 3 (measured in the diagonal of the matrix) were 50 mm, and their length $l_1$ was established at 140 mm.

FIG. 2 shows the unfavourable case of a projectile impacting obliquely on the rods 3, only the nose 101 thereof and the impact fuse 102 being shown. In this case, the piezo generator can be activated before the nose 101 is broken through, so that further protective measures in the protective layer 1 are required.

FIG. 3 shows a similar situation, but here the probability of ignition of the hollow charge is already substantially smaller, since a rod 3 has already broken through and short-circuited the nose 101 before the impact fuse 102 has made contact with a further rod.

FIGS. 4*a* and 4*b* show measures for improving the protective action. For it has been shown that piezoelectric impact fuses which impact on the tips 3' of the rods 3 directly frontally are often completely destroyed before they generate a sufficiently high ignition voltage. The prerequisite for such destruction is extremely high surface pressures, i.e. impulses such as are achieved by a blunt-angled cone 5 with a sharp-edged tip 6 (FIG. 4*a*) or by a sharp-edged stud 7 of a diameter of 1 to 2 mm (FIG. 4*b*).

Departing from the finding from FIGS. 2 and 3, in FIG. 5 the rods 3 are inserted into the base plate 2 at an angle of inclination $\alpha$, an imaginary direction of flight $F_f$ which corresponds to the threat having been assumed here. The inner surface of the base plate 2 is again designated 2'. This makes it possible, as FIG. 5 shows, also optimally to protect inclined surfaces.

FIG. 6 shows a protective layer 1 with an inner crumple layer 8 consisting of a corrugated perforated plate made of steel which can absorb kinetic energy if the projectile penetrates obliquely and/or if the charge thereof is ignited. In this case, then also the effect of a hollow charge jet is reduced, because the optimum distance from the target, i.e. the object to be protected O, is exceeded by 2 to 3 times the calibre (standoff). In order that the length of the rods 3 is not below the effective length $l_1$ (cf. FIG. 1), the highest position of the surface 2', i.e. the "wave crests" of the layer 8, is selected as a basis for measurement. In order to prevent unintentional injury and also soiling and becoming entangled with any objects (branches etc.), the rods 3 are covered by a lightweight foam 9 (commercially available polymer). To the sides there are covering means 10 made from thin-walled aluminium plates.

The subject of FIG. 7 is constructed analogously, but here the crumple layer 8 consists of a composite plate made of metal and plastics materials. Again here the basis for measurement, the surface 2', is noted for the length $l_1$ of the rods 3. In contrast to FIG. 6, here covering of the modular protective layer 1 on all sides takes place with UV-resistant plastics panels.

In FIG. 8, on an armoured vehicle 110 the windscreens are provided with a protective layer 1 which is see-through and adjustable. The rods 3 which are arranged tiltably in rows R1 to Rn, in lateral bearing means 13' can be adjusted to the current threat by a drive means 13 with articulated connections 12. The drive means 13 is incorporated in a roof protection 16 which is known per se and therefore is shown in broken lines.

Of course, an analogous arrangement can also be provided for the side windows which are not protected in the drawing.

In the illustration FIG. 1, a particularly weight-saving development is shown. A rod 3*a* consists of a rigid composite material produced with carbon fibres. In order to improve the conductivity, this rod is metallised on its surface 3*a* which faces the threat over one third of the entire length $l_1$ and bears metallic tips 3'. A coating m which is as hard as possible, which in the present case consists either of titanium carbonitride (TiCN) or titanium nitride (TiN), is a possible solution as galvanically conductive layer. The colour of the coating is selected according to the camouflage colour of the object. A further advantage of this embodiment is the small radar cross-section, i.e. it contributes little to radar detection and does not adversely affect the other "camouflage" means. Rods in this embodiment are mainly provided for movable protective layers, analogously to FIG. 8.

An armed tracked vehicle, FIG. 9, an armoured personnel carrier 111 for protected transport of troops, is equipped with modular protective layers 1 according to FIG. 7. In addition, the two movable optical sensors 112 (controllable thermal imaging cameras) are protected from direct shelling by adapted lateral covering means 10 (protective layers) with integrated rods 3. For drawing-related reasons, here the lightweight foam layer which is likewise present, cf. FIGS. 6 and 7, is not shown.

Such protective layers 10 are recommended for all entry and exit points, such as for example also for air intakes and exhaust openings on vehicles or stationary installations. By way of example, here lateral air intakes 17 on the armoured personnel carrier 111 are provided with rods 3 and are thus protected.

One further variant of a protective layer 1' consists of a steel net which is known per se, FIG. 10, in the nodes 14 of which rods 3 are inserted. The rods 3 are protected from twisting by means of one node sheet 15 in each case. Here again, the basis for measurement for the length of the rods 3 is the surface 2', which corresponds to the maximum level of the node sheets 15. What are not shown are welds on the node sheets 15, which impart the necessary stability to the rods 3. The node sheets 15 together with the meshes of the net 2*a* assume the function of a plate 2, 2'; cf. FIG. 1 to FIG. 7. Unlike a plate, however, a net 2*a* can be readily adapted to the spatial forms of an object to be protected.

In addition to the saving in weight and costs, with this embodiment effectively and in a very short time at-risk objects such as entrances, windows, shafts and the like can be protected from attack.

In a lightweight version according to FIG. 11, the rods 3" of a protective layer are produced from individual metal strips 50 which have been cut out by means of beam machining (laser). The height of the metal strips 50 corresponds to the length $l_1$ plus a web width 51 which is adapted to the design, which is determined according to the base plate or carriers R1-Rn. Cutouts A have been cut out in order to reduce the weight. The parts which are fitted together in a positively locking manner are welded together—not shown in FIG. 11—in non-positive manner. The metal sheet used for the rods 3" is steel sheet of a thickness of several millimetres, likewise high-strength aluminium sheets can be used. For this, jet machining by means of a high-pressure water jet which is likewise known per se is used.

Here the webs assume the function of the plate (FIG. 1 to FIG. 7). This variant likewise makes it possible very quickly to retrofit object protection. Given corresponding dimensions of the webs (bendable cross-sections), also curved surfaces can be covered without gaps by a protective layer.

The protective layers produced according to FIG. 11 are distinguished—in contrast to conventional protective measures—by a relatively low weight per unit surface area of 40 kg/m$^2$ (mean value). The subject of the invention can be adapted to the threat within broad limits. The materials and technologies used are conventional and can also be constantly substituted by new and better materials, inter alia composite materials. Likewise, the subject can analogously be adapted to means to counter detection by means of electromagnetic radiation already present on the object to be protected, or such can be integrated.

For all the examples of embodiment, it is recommended to connect the rods and metal parts 3, 3*b*, 3"; R1-Rn to earth (earthing), so that any potentials present upon the activation of the ignition device are reliably discharged before they can reach the ignition chain.

The subject of the invention is not limited to projectiles with hollow charges. It can be used against any projectiles the ignition operation of which is disrupted by an electrically short-circuited or earthed, planar connection cable. In such case, it can be assumed that the nominal ignition energy of an impact fuse is necessary for initiation of an active charge and that any partial currents still present are not sufficient for this.

LIST OF DESIGNATIONS

1 protective layer
1' steel net
1*a* protective layer for entry and exit points
2 base plate
2*a* net (meshes)
2' inner surface
3 rod (steel round bar)
3*a* rod (wound from carbon fibres)
3*b* free end region of 3
3' end faces of 3

3" rod (flat bar)
4 flange
5 cone
6 tip (sharp)
7 sharp-edged stud
8 crumple layer
9 lightweight foam (polymer layer)
10 lateral covering means/protective layers
11 composite plate
12 articulated connection
13 drive means for 12
13' lateral bearings
14 nodes
15 node sheet (bracing)
16 roof protection
17 lateral air inlets
50 metal strip
51 web width
100 projectile
101 nose
102 impact fuse with piezo generator or piezo sensor
103 hollow charge
104 liner
110 armoured vehicle
111 armoured personnel carrier
112 optical sensors/cameras
A cutouts
a maximum distance between two rods
$\alpha$ angle of inclination rods/base plate
F direction of flight of projectile (at the target)
$F_f$ imaginary direction of flight (threat)
K calibre of the projectile
$l_0$ length of nose
$l_1$ length of rod (measured from 2')
m metallic coating
O object to be protected
R1-Rn carriers for rows of 3

The invention claimed is:

1. A protective layer for protection of an object against an active projectile having a tip and a selected calibre, the protective layer comprising metallic rods arranged in a matrix and projecting from the object to be protected, each rod having an end region remote from the object to be protected with a galvanically conductive surface, wherein each rod comprises a substantially electrically non-conductive material and has a galvanically conductive coating in the end region, and wherein the rods project beyond an upper inner surface of the protective layer.

2. The protective layer according to claim 1, wherein the rods have outer end faces covered by at least one planar and continuous outer layer.

3. The protective layer according to claim 2, wherein the outer end faces of the rods have obtuse-angled cones ending in sharp cone tips.

4. The protective layer according to claim 2, wherein the outer end faces of the rods are stepped and have a central sharp-edged stud.

* * * * *